US009375126B2

(12) United States Patent
Abdulfattah et al.

(10) Patent No.: US 9,375,126 B2
(45) Date of Patent: Jun. 28, 2016

(54) WATERLESS DISHWASHER

(75) Inventors: Abdulrahman Abdulfattah, Jeddah (SA); Abdo A. Husseiny, LaPlace, LA (US); Esam Al-Filali, Jeddah (SA); Nablia Bahjat, legal representative, Jeddah (SA)

(73) Assignees: KING ABDULAZIZ UNIVERSITY, Jeddah (SA); TECHNOLOGY INTERNATIONAL, INC., LaPlace, LA (US)

( * ) Notice: Subject to any disclaimer, the term of this patent is extended or adjusted under 35 U.S.C. 154(b) by 29 days.

(21) Appl. No.: 13/327,048

(22) Filed: Dec. 15, 2011

(65) Prior Publication Data

US 2014/0102485 A1 Apr. 17, 2014

Related U.S. Application Data

(60) Provisional application No. 61/527,444, filed on Aug. 25, 2011.

(51) Int. Cl.
*A47L 15/00* (2006.01)
*A47L 15/24* (2006.01)

(52) U.S. Cl.
CPC ..... *A47L 15/0094* (2013.01); *A47L 15/241* (2013.01)

(58) Field of Classification Search
CPC ..... A47L 15/0094; A47L 15/241; B24C 1/00
USPC ..... 134/25.2, 151
See application file for complete search history.

(56) References Cited

U.S. PATENT DOCUMENTS

| | | | | |
|---|---|---|---|---|
| 4,801,333 | A * | 1/1989 | Mosell | 134/7 |
| 5,588,901 | A * | 12/1996 | Rubey et al. | 451/99 |
| 6,343,611 | B1 * | 2/2002 | El-Shoubary et al. | 134/109 |
| 2010/0043844 | A1 * | 2/2010 | Han et al. | 134/102.1 |

FOREIGN PATENT DOCUMENTS

| | | | | |
|---|---|---|---|---|
| EP | 0016895 | A1 * | 10/1980 | A47L 15/00 |
| JP | H-11138440 | A * | 5/1999 | A47L 15/00 |
| JP | 20001339796 | A * | 5/2000 | A47L 15/00 |

OTHER PUBLICATIONS

Machine English Translation of Description of JPH11138440 (Fumio et al. 1999).*
English Machine Translation of Description of JP2000139796A (Hayashida et al., May 2000).*

* cited by examiner

*Primary Examiner* — Joseph L Perrin
*Assistant Examiner* — Irina Graf
(74) *Attorney, Agent, or Firm* — Studebaker & Brackett PC

(57) ABSTRACT

A dishwashing system for cleaning soiled kitchenware, dishware and utensils is provided. The dishwashing system uses a combination of compressed air and blasting media to thoroughly remove grease and loose as well as hardened food particles from soiled surfaces, without hand tool scrubbing, manual rinsing, or use of soap, detergent, surfactants or other chemicals, whether in pre-soaking or cleaning. This heavy-duty dishwashing system accomplishes this thorough cleaning using no or a minuscule quantity of water. The overall energy requirements are low compared to existing systems due to elimination of water, reduction of the heating load and possible use of the heat of incineration. The dishwashing system may include a system for reclaiming used blasting media by separation from food residues. The dishwashing system is most appropriate for locations where freshwater is unavailable or costly, such as arid zones and aboard ships, and where disposal of gray water is impermissible.

19 Claims, 4 Drawing Sheets

WATERLESS DISHWASHER

TECHNICAL FIELD

This disclosure relates to an apparatus and methods for cleaning large quantities of kitchenware, dishware, tableware, flatware, dinnerware, hollowware, utensils, and the like. More particularly, the disclosed apparatus and methods relate to a mobile, easy to assemble and disassemble, environment-friendly, heavy duty mass dishwasher system that utilizes blasting technology for effectively and thoroughly cleaning large quantities of pots, pans, plates, dishes, utensils and the like in areas with a scarce fresh water supply and aboard marine ships, without surface wear, damage or breakage of fragile items, without the use of chemical detergents and in a manner substantially limiting the use of water and eliminating waste streams.

BACKGROUND

Throughout this disclosure, the terms dishes and dishware will be considered to include water washable kitchenware, dishware, tableware, flatware, dinnerware, hollowware, utensils and the like commonly used for preparing, cooking, serving and consuming meals. The terms mobile and nomadic will refer to an apparatus that is self-contained, has a relatively small foot print, is skid-mounted or trailer-mounted, is easy to assemble and disassemble and can be moved from one location to another. The terms mass and high volume will refer to an apparatus that is designed and constructed to operate in continuous or batch mode to serve a large group of people in a small community, a population pocket or a remote campsite, mess hall, cafeteria, aboard ship and the like. The use of this terminology is for simplicity in explaining the applicability of the enclosed apparatus and methods, unless specifically excepted.

Dishware cleaning is an important function in preventing the proliferation of potentially harmful bacteria, preventing the attraction of a variety of undesirable creatures, such as bugs, roaches, mice and rats, enhancing the aesthetics of dishware and for other health, cultural or appearance purposes. Water and detergent have frequently been the method of cleaning dishware. However, water is increasingly in short supply in many places in the world and detergent is relatively costly, can be difficult to transport, and has potential environmental affects. Furthermore, isolated population pockets and remote campsites as well as arid and desert regions lack ample freshwater resources and wastewater processing facilities. Ocean- and sea-going marine vessels have limited fresh water supply and harsh restrictions on disposal of gray water and black water at sea.

Sand and silica have also been a media of choice for scrubbing and cleaning kitchenware and dishware, particularly for camping dishware. Sand is still used today by nomads and scouts to remove stubborn grease and burned and hardened food particles from scorched surfaces, and to remove soot accumulating on pots and pans used for cooking on open fires, especially in situations where there is no detergent and very little water. Sand cleaning provides a shine on the surface of utensils and cookware, preserving the surface luster of copper and stainless steel pots and pans. Indeed, some detergents contain abrasive particles for washing highly soiled dishes and stained and grimy clothes. Some specialty soap may also contain abrasive particles for cleaning skin soiled by hard-to-remove lubricants and crude oil.

Thus, fine sand and silica particles may be used in cleaning cookware, kitchenware and tableware whenever water and detergent are not available or do not provide the desired cleanliness of surfaces without extensive waste of resources and effort.

In rugged areas inhabited by nomads, remote desert pockets of population, arid land and wasteland, people are crowded around very limited water sources, where utility services are often beyond reach. Such areas are often the preferred locations for military and civilian camps. In these areas, cleaning cookware and food service ware is difficult and the logistics of constructing water wasteful and detergent demanding dishwashing systems with adequate plumbing are rather complex.

To reduce the amount of water required to clean pots and pans in the battlefield, Muller et al. proposed a chemical sanitation system that effectively cleaned and sanitized pots and pans at cold water temperatures, 15 to 20 degrees Celsius, as reported in Wayne S. Muller et al., Chemical Sanitation System for Pots and Pans in Field Operations, report #NATICK/TR-89/020, U.S. Army Natick Research, Development, and Engineering Center, Natick, Mass. (February 1989). While effective at sanitizing, this system had difficulty removing grease at this temperature range. At this time, no commercial product or combination of products available can effectively clean all types of food residue from pots and pans at these temperatures.

McCormick, et al. developed a procedure to clean and sanitize kitchenware in ambient cold water during emergency situations, in which dirty pots, pans, and kitchen utensils could be successfully cleaned and degreased, starting by hand-scrubbing the kitchenware in a sink containing a 5% solution of a commercial cleaner/degreaser at 15 degrees Celsius, as reported by Neil G. McCormick and R. G. Flaig, Cold Water Cleaning and Sanitizing of Kitchenware in the Field, report #NATICK/TR-90/013, U.S. Army Natick Research Development, and Engineering Center, Natick, Mass. (December 1989). The scrubbed article was then rinsed in a sink filled with water held at 15 degrees Celsius and sanitized in a third sink containing a 15 degrees Celsius solution of a commercial quaternary ammonium sanitizing agent. Results from swab tests performed on processed articles showed the number of bacteria to be well below the permissible level, if not completely absent. The procedure was judged highly successful in cleaning, degreasing and sanitizing kitchenware in cold water. This same procedure also successfully cleaned and sanitized individual mess gear in a field test situation using water at 20 degrees Celsius. However, using such a chemical procedure creates pollution problems with the disposal of gray water and the chemicals used to clean the kitchenware.

Certain solvents, along with a surface wetting agent, may replace water detergent in a process similar to dry-cleaning clothing. Furthermore, some solvents used in dry-cleaning, such as tetrachloroethylene (TCE) and Stoddard solvent, can remove various types of stains and grease and thus may have potential uses for cleaning dishware. Nash et al. found that certain surfactants are especially useful for degreasing and removal of oils as reported by J. Nash et al., Surfactant-Enhanced in Situ Soils Washing, report #AFESC/ESL-TR87-18, Engineering and Services Lab, Air Force Engineering and Services Center, Tyndall AFB, Fl. (1987). As these chemicals are of relatively small volume relative to the amount of water used in traditional processes, such chemicals would be fairly easy to store and reusable after filtering.

Accordingly, there is a need in desert population centers, either temporary or permanent, for a dishwashing system that is easy to assemble and to disassemble and provides service for large groups on as-needed basis, while preserving limited vital resources such as water, causing no pollution to those resources, and requiring very little supply of consumables.

In order to understand the background of dishwashing better, hereinbelow are a variety of situations concerns associated with cleaning in general and cleaning dishes specifically, along with current techniques and needs.

Conventional Dishwashing Mechanisms

Conventional dishwashing processes are often a multi-stage process. The first stage may be a manual rough scrubbing. This scrubbing is often carried out by scrubbers with large, coarse bristles, the purpose of which is to remove large food residue. Note that modern dishwashing machines allow for the presence and removal of large food residue. After the rough scrubbing step, manual fine scrubbing of the remaining residue and stains takes place, using scrubbers with fine bristles, by hot water jets or nozzles or by a combination of both. In the next stage, a combination of hot water and detergent in the form of jets or sprays clean residues such as grease, soil, and small food particles, as well as the liquid films that may form when the aforementioned residues combine with water. Next, the dishware receives rinsing and sanitizing using hot water. In a final stage, water may drain from the dishware and hot air may blow on the dishware to aid in removal of bulk water and to speed drying of the dishes. As a separate step and possibly in parallel to the aforementioned steps, residue and waste are carried in water or are dissolved in water and are drained from the dishwashing apparatus, possibly with the aid of partial vacuum pressure or suction. One or more portions of the aforementioned steps may be automated. The trend in home appliances is to automate the entire process fully. In general, most dishwashing processes would include stages of scrubbing, degreasing, de-staining or fine scrubbing, dishware cleaning, sanitizing, drying, and disposal of liquid/slurry waste, including food debris.

Environmental Challenges of High Volume Dishwashing

Typically, the procedures followed to clean dishware in a large mess hall or a cafeteria capable of feeding many people involve placing dishware, including ware for bulk food preparation, in a rack and positioning the rack, which may be full, on a conveyor belt of the dishwasher. The conveyor belt then moves one or more racks to a location between water jet nozzles positioned above and below the rack. The water jet nozzles remove loose food residue from the dishware. During the first stage of the wash cycle, detergent from an attached dispenser dissolves in pressurized heated water at about 71 degrees Celsius, which then sprays from the nozzles to remove food residue from the dishware. The racks continue along the conveyor belt to a rinse stage, passing through a second set of water jet nozzles located above and below the conveyor, which spray pressurized water at about 82 degrees Celsius to rinse and sanitize or sterilize the washed dishware. After passing through the rinse stage, racks may be stacked with clean dishes ready for use or an operator may remove the dishes from the racks and store them or position them for reuse. Some dishwashers may have a drying step or stage. The configuration of racks allows water to drain from the racks and permits airflow to assist in and accelerate the drying process.

The main advantage of the conveyor system is that it enables dishware to be washed quickly and continuously through a systematic and mostly automated process without interruption. The user of the dishwasher may then use fewer dishes, utensils, pots, pans, flatware, etc., i.e., dishware, to serve a large number of people since the dishwasher quickly returns dishware to service. A conveyor dishwasher also reduces the labor required to clean dishware. This system is particularly useful when feeding large numbers of people over an extended long period. Thus, multiple eaters may use a single item of dishware during a single day and potentially a single meal because of the rapidity with which a dishwasher may restore dishware to service.

While high volume dishwashers provide advantages in efficiency and speed, especially in situations involving mass feeding and batch feeding, they also consume tremendous amounts of freshwater even when a filtration system recycles rinse water for reuse. These systems also discharge large volumes of wastewater, which exacerbates the problem of mass effluent disposal. While wastewater can drain directly to an existing storm sewer system, chemicals in wastewater may cause pollution problems at the location where the wastewater discharges. Even treatment of the wastewater may leave residual chemicals in the filtrate and produce a secondary stream containing suspended or dissolved chemicals. In arid zones and rural areas, wastewater discharge may seep directly to the ground, potentially polluting the water table. Though biodegradable detergents theoretically reduce pollution, the time it takes for the detergents to become inert may allow the detergents to accumulate in the water table or the local ground water supply.

Thus, in addition to the need for a dishwashing system for arid zones or remote areas, there is a second need for such a dishwashing system to reduce the volume of both freshwater used and wastewater produced, particularly in areas with scarce freshwater supplies and no or inadequate wastewater disposal facilities. In addition, the waste generated from a dishwashing apparatus should be minimized by recycling and disposed of in an environmentally friendly manner.

Marine and Shipboard Cleaning of Dishware

The discussion of needs thus far has generally focused on remote, water-scarce, and arid regions. However, ships having a dishwashing capability present a similar and significant challenge. Typically, the dishwasher in a large ship's scullery contains two water tanks with heating elements to warm water used for cleaning dishware. One water tank holds a mixture of detergent and water for cleaning, while the other tank holds rinse water. While the water in each tank may be used multiple times during a given meal, the scullery system's tanks are usually drained and cleaned at the end of a meal. Since the runoff water from the dishwasher becomes contaminated with detergent and food matter, the water is considered gray water and must be stored for later disposal along with similar waste water collected from the galley, laundry, showers, sinks and other miscellaneous shipboard sources while a ship is operating within a protected zone of a country's coastal waters. A ship serves three meals per day in port and four meals per day when underway, thus generating significant quantities of gray water. The volume of gray water produced by the scullery is a significant portion of total gray water produced, as a typical large ship serves three meals per day in port and four meals per day when at sea.

Other dishwashers may exist aboard a ship, such as those in the wardroom pantry or in the captain's room. These other dishwashers may use different procedures, but still use a significant volume of fresh water and still produce a significant volume of gray water. The manual operation of these dishwashers proceeds as follows. First, the drains are closed. Second, the doors are closed. Third, the tank fill switch is set to an "on" position. Fourth, the tank will fill for about three minutes, and then the tank fill switch is set to the "off" position. Fifth, tank heat is set to an "on" position and the operator will wait for the tank to reach a temperature of about 66 degrees Celsius. Sixth, the operator opens the dishwasher door and the operator will place a rack loaded with dishes into the dishwasher. Seventh, the operator will close the dishwasher door. Eighth, the operator will activate the "start" switch to cause the dishwasher to operate through a complete cycle, which may contain one or more wash and rinse cycles. Ninth, the operator will remove the rack. The operator will then repeat the sixth, seventh and eighth steps. The dishwasher tanks require draining after each cycle. These dishwashers generally employ water jets to remove food debris, to clean, to rinse, and to sterilize dishware, simultaneously producing gray water.

Effluent from dishwashers may represent more than 25% of a marine ship's generated gray water. Dishwashers contribute significantly to the size and cost of subsequent shipboard treatment systems as well as the requirement for freshwater. The problem of shipboard gray water has been of concern in terms of characterizing gray water waste, evaluating shipboard waste treatment units, assessing the environmental affect of gray water treatment, evaluating shore-side waste disposal facilities, and assessing the technical and economic effects of gray water treatment and retention. On some ships and in some situations, gray water may drain to the sanitary sewage system, increasing the volume of that type of wastewater.

Tighter regulations due to legislation, such as the Clean Water Act and the Marine Protection, Research and Sanctuaries Act (MPRSA), which govern estuaries, coastal waterways, and the open ocean, and international conventions such as the London Dumping Convention, the 1974 Oslo Convention, and the International Convention for Prevention of Pollution from Ships (MARPOL), make the need for stringent control of waste streams in naval and marine vessels imperative to prevent loss of access to foreign or domestic ports. If a ship or vessel is unable to comply with operational or homeport restrictions in environmentally sensitive waters, then costlier alternatives to shipping by water may be required.

Thus, there is a need for a dishwasher that significantly reduces use of fresh water on civilian and military ships and subsequently reduces the storage space required for fresh water. Elimination or substantial reduction of dishwashing water effluent would also reduce the volume of gray water, minimizing gray water storage space and simplifying the logistics of gray water disposal. Disposal of gray water at sea is no longer possible due to potential hazards to marine life and the possibility that gray water may drift to shore, in addition to both domestic and international laws governing the disposal of waste in domestic and international waters. At the same time, a dishwashing system with little or no wastewater effluent aboard ships would enable ships to hold gray water for greater periods without the need for onboard treatment system. Alternatively, the overall volume of gray water has to be reduced as well by filtration and recycling to minimize the space required for storage of the produced gray water.

Home Dishwashing

Small dishwashing units such as those used in homes are closed systems that operate slightly differently as compared to mass dishwashing systems. These smaller units lack a flow-through design, which is unnecessary because home meals typically use fewer total dishes or dishware. However, as with larger dishwashing units, small dishwashers also typically contain nozzles for a mixture of detergent and water and for rinse water. Because of space considerations in a home, home dishwashers lack a conveyor system and may have only one tank, requiring draining of water between a cleaning cycle and a rinse cycle rather than reuse. Dishes cleaned in a dishwasher require approximately 37% less water than those washed by hand. If a sink's washbasin and rinse basin contain standing water rather than permitting an associated faucet to run, hand washing may use as little as half as much water as a dishwasher. However, hand cleaned dishware should still have a sterilization step of some type, either with sufficient heat to kill germs or some other means.

Most modern dishwashing appliances have several dishwashing cycles that may be appropriately selected to meet the requirements of a specific load of dishware depending on the soil conditions of the dishware. Selecting a cycle designed to clean more food residue or a cycle longer than necessary will unnecessarily increase water or hot water consumption and will waste energy, water and detergent while incurring additional and unnecessary cost for the superfluous inputs. In contrast, choosing a cycle insufficient for the soil condition of dishware may result in the dishware being inadequately washed, possibly requiring subsequent washing either by hand or through another dishwashing cycle. "Smart" dishwashers that detect the soil condition of a load and then select a dishwashing cycle pattern that matches the soil condition may mitigate or prevent improper cycle selection, reducing wasted energy, water and detergent.

Typical dishwashers need water sufficiently hot to melt dishwasher soap, which melts faster and more thoroughly at higher water temperature, and to clean dishes contaminated by grease. An optimal temperature might be 60 degrees Celsius. As much as 80% of the energy used by a dishwasher is used to heat water. This energy usage may be reduced by using a dishwasher with a booster heater that provides water hot enough to sanitize dishware with the home's water heater set at about 49 degrees Celsius. Furthermore, using a smaller volume of water consumes less energy to heat, reduces the amount of water needing treatment to make it suitable for use as wash water, reduces the amount pumped to the home, and decreases the amount needing treatment at a waste facility. Supplying water and treating water after use can be up to 50% of a typical city's energy bill.

Thus, there is a need in the art to develop a domestic dishwasher that reduces water consumption for even a "heavy soil" cycle, which would save energy and money for both the end user and the utility supplier.

Environmental Concerns

Water Input and Output

Minimizing wastewater on land is also becoming a high priority in many areas due to wastewater produced by mass dishwashing systems typically used in institutional kitchens, large food service facilities, and dining facilities. A large volume of wastewater poses particular problems in areas with a limited supply of fresh water combined with expansion in wastewater production. In and areas, scarcity of water requires strict fresh water conservation measures. Furthermore, campsites are often located in areas with a scarcity of water. Thus, any water saving device or method that helps to reduce the total volume of water demanded is desirable.

Operators of dishwashers, whether commercial or domestic, differ in the way they prepare the dishwasher load. Some operators scrape loose soil and food particles from dishware, while some use detergent to assure dissolving of grease and scum and to remove any grime that may accumulate when dishware sits for some time before cleaning Other operators soak dishware in a sink filled with detergent-laden hot water and rinse most or all dishware thoroughly before loading the dishwasher. Thus, dishwashers are often times used just for sanitation, which is an extremely water-wasteful practice and is often very wasteful of energy, if the water used for sink soaking and rinsing has been heated. The gray water byproduct from preparation for the dishwashing machine may exceed the gray water rejected by the dishwashing machine throughout the washing cycle.

To alleviate the effect of such wasteful practices, to conserve water and energy, and to reduce the environmental burden while enhancing the economics of operation, dishwashers may include a "rinse and hold" detergentless short rinse cycle to remove loose soil from partial loads after scraping, flushing loose soil and gray water down the drain.

Commercial and domestic dishwashing systems use a variety of chemical detergents to break down grease and scum. The presence of chemicals in addition to food particles and oils in the gray water stream complicates the disposal and treatment of the wastewater. Any amount of detergent over that needed for a given load will result in a relatively large amount of unused detergent discharge along with the gray water, causing environmental pollution. In addition, detergent molecules attach themselves to soil particles and accompany those soil particles into the environment. While there has been a trend toward using detergents and surfactants without a record of harming the environment, these detergents and surfactants only change the composition of chemicals in the wastewater; the quantity of chemicals released remains comparable and the flow of spent chemicals polluting the environment continues. Although biodegradable detergents minimize the environmental effect of releasing wastewater to the environment, the presence of detergent in the waste stream still requires special handling.

Thus, there is a need in the appliance industry for a dishwasher that can be partially loaded with dishware after scraping off loose food particles and operates only when the dishwashing unit is fully loaded, without requiring pre-removal of soil, detergent or a rinse-and-hold cycle.

There is also a need for a waterless dishwasher or a dishwasher that consumes minimal quantities of fresh water to clean kitchenware and dishware generally and in fresh water-scarce areas in particular.

There is also a long recognized and unfilled need to reduce the amount of polluting detergent chemicals discharged into the environment and to reduce secondary waste streams. A preferable dishwashing apparatus or method would avoid the use of chemical detergent.

Environmental Concerns

Energy Usage

In dishwashers, the washing cycle requires a large amount of energy. This energy includes that used by the hot water heater and the electrical energy used to run both the dishwasher pump and the resistance-heating element enclosed in the dishwasher to boost the water temperature and to dry the dishware. In a normal cycle, a typical domestic dishwasher requires about 34.5 liters of water per load. The hot water used by such a dishwasher is first warmed by a hot water heater from a home's cold water source that may have a temperature of 10° C.-20° C. to the hot water heater's water temperature of at about 49° C. Each dishwasher load requires about six fills of fresh hot water, ranging from approximately 5.3 liters to approximately 7 liters. The first two fills are needed for pre-wash cycles, followed by a fresh fill for the main wash cycles. The last three fills are needed for two post rinse and one final rinse cycles. Assuming a perfectly efficient heating process, raising the temperature of the water by an increment of 29 to 39 degrees Celsius requires 1.13-1.53 kWh of water heating energy, which is directly proportional to the water volume. The average mechanical energy consumption per cycle is approximately 0.65 kWh. The average total energy consumption for a regular dishwashing cycle is from approximately 1.78 kWh to approximately 2.18 kWh. Home dishwashers do not normally reuse water from one cycle to the next. Reusing or recycling hot water from one cycle to the next cycle would require at least a screen and centrifuge to separate soil particles from the water. The screens are inefficient and impractical since they need frequent removal and cleaning to prevent bacterial growth and accumulation of scum, while the moving parts of the centrifuge require additional space and energy as well as periodic maintenance in order to continue to remove particles from the water effectively.

Commercial heavy-duty dishwashing machines, such as those used in the scullery, in cafeterias, in a military mess, or in large dining facilities employ a conveyor belt to move racks of dishes between water jet nozzles positioned above and below the rack in order to remove food and residue from dishware. During the first part of the cycle, heated water at about 71° C. and detergent is sprayed through high-pressure nozzles to clean the dishware. During the second part of the cleaning cycle, hotter water at 82° C. is sprayed under pressure to rinse and sterilize the washed dishware. Commercial and institutional environments require sterilization at much higher temperatures than do home appliances due to a risk of contamination and bacterial growth. Commercial and institutional dishwashing systems also require much larger quantities of water than home dishwashers require and thus incur the energy expense of heating a correspondingly larger volume of water. In commercial and institutional settings, dishware is often heavily soiled, producing wastewater that contains significant amounts of food particles. Ultra-filtration units are needed to quickly remove suspended or dissolved solids from this water so that it may be recycled or reused, requiring a significant additional energy cost to offset the savings in not having to heat as much water.

U.S. Pat. Nos. 6,343,611 and 6,001,190 to El-Shoubary et al. describes a dishwasher having a standard normal operating cycle. The dishwasher includes a container for accommodating a plurality of articles, a circulation pump for delivering a liquid to the container and for circulating the liquid within the container, and a diverter connected to the circulation pump for diverting at least a portion of the circulating liquid to a hydroclone. At least 90% of the liquid diverted to the hydroclone returns to the circulating liquid, the returned liquid having at most about 0.02% solids.

Several dishwasher improvements were introduced to enhance the cleaning efficiency, to reduce energy or to reduce water use. U.S. Pat. No. 5,947,135 to Sumida et al. relates to simultaneously producing two kinds of ionized water for use as washing water without being discarded before use, so that water saving can be achieved. When tableware is washed and rinsed in a dishwasher, the tableware is washed within ten minutes using acid ionized water having a pH value of at most 6.0 and a temperature of at least 40 degrees Celsius in a first washing step, whereby dirt coheres and thus is prevented from being reattached to the tableware so that a washing load in the following washing steps is reduced. Next, the tableware is washed for at least fifteen (15) minutes with alkaline ionized water having a pH value of at least 8.5 and a temperature of at least 55 degrees Celsius in at least one of the washing steps, whereby the washing effects on fats and oils, protein and starch are improved. While the two kinds of ionized water are being produced simultaneously, one batch of ionized water is supplied to a washing vessel for use in the present washing cycle and the other batch of ionized water is supplied to and stored in a water tank for use in the next washing cycle, so that two or more water tanks are not necessary, resulting in reduction in size of dishwashers and in manufacturing cost.

Accordingly, there is a need for reducing energy consumption during wash loads of dishwashers without significantly increasing the time required for cleaning or increasing the amount of freshwater required for cleaning. Reducing the volume of hot water used by a dishwasher decreases the amount of water that needs heating and would indirectly reduce the dishwasher's overall energy consumption.

Ultrasonic and High-Tech Cleaning

Ultrasonic cleaning and polishing of precious stones, jewelry and other fine articles is common. Ultrasonic cleaning typically uses a relatively small amount of water and chemicals. Ultrasonic cleaning of semiconductors, metal strips, fragile membranes, and delicate fabrics is also common, typically by enhancing the reactivity of cleaning agents and solvents with ultrasonic excitation. Though ultrasonic cleaning of larger items without detergent in conventional cleaning processes has remained a challenge, the production of small sized transducers and development of durable materials for transducers has enabled the creation of larger transducer-based ultrasonic cleaning systems. Ultrasonic excitation of dry cleaning solvents to clean delicate fabrics has also been successful. There has been research on the cleaning potential of ultrasonic vibrations for various types of detailed cleaning, but the research thus far still require the use of solvents and detergents.

The physical theory behind ultrasonic cleaning is based on acoustical cavitation in liquid films. The intense sound waves provided by ultrasonic transducers create alternating regions of compression and expansion in a liquid, forming bubbles with a diameter that is dependent on the frequency of the transducer. For example, the bubbles may have a diameter of one hundred microns (100 μm). If the bubble is of the critical size, as determined by the frequency of the ultrasonic waves, the bubble may implode violently, releasing energy and creating a localized hot spot with an approximate temperature of 5,500 degrees Celsius. Since this region is small, the heat dissipates quickly and the bulk of the liquid remains at ambient temperature or an elevated temperature if the ultrasonic cleaner includes a heater. As the bubbles at or near a surface implode, micron-sized particles can be released into the surroundings if the acoustical pressure of the transducers is of adequate magnitude, that is, if high power ultrasonic transducers are used. Transforming the residues on a surface to micron-sized particles for disposal is the basis of the ultrasonic cleaning process.

An ultrasonic dishwashing process may flow in the following sequence. Step 1: Manual or mechanical scrubbing of large food residue by scrubbers, brushes, or sand blasting. Step 2: The liquid film on the dishes, which includes water, grease and food particles, is subjected to an ultrasonic field, causing cavitation in the liquid film and "vaporization" of the film into very small droplets about 1 micron in size. The droplets take the form of a mist that carries water and small food particles away. Step 3: To dry the suspended food particles for disposal, the mist resulting from the ultrasonic process is subjected to another process such as heated air or an additional sonic field that causes a phase change in water. After the water has evaporated, the remaining dried food particles are collected for discarding. Step 4: A partial vacuum pressure withdraws the dried food particles.

The transducers in this process need to be close to the dishware. The sonification of the liquid film containing food residue will create a fine vapor that contains food particles or residue in solution or suspension. This method most closely resembles spray drying. The ultrasonic approach, however, results in finer particles, which promotes more rapid drying and lower dishware temperatures. In addition, limitations of spray drying, such as clogging and feed considerations, do not apply since ultrasonic energy accomplishes the atomization of food residue. Because of the short time required to accomplish cleaning, the speed and economy of this process should rival current freeze drying techniques while yielding high quality cleaning.

Step 1 and step 2 employed in the ultrasonic dishwashing process may be replaced by pulsating dry steam jets and timed sprayers that spray a grease dissolving agent in small quantities at the beginning of the cycle. This action is sufficient for washing dishes while producing minimum moisture. Following the dry steam jets and timed sprayers may be hot air jets to dry the dishware. Although this process will reduce water requirements compared to the ultrasonic method, an undesirable chemical waste stream will result from the grease-dissolving agent.

An alternative configuration is the use of ultrasonic nozzles, which will result in atomization of the liquid film and rapid, efficient drying. This process may replace step 2 described above.

An automated processing conveyor (similar to an assembly line) may be employed in moving dishware to a scrubbing station, a washing station, and then a drying station. The scrubbing will be similar to Step 1 above. The wash station may involve three stages. In the first stage, spraying nozzles spray a light mist of water with detergent, followed by a light scrubbing stage, and then a pure water mist spraying as a rinse stage. The drying station will use hot air. In this process, the dishes will be stacked in a manner that allows rotation and exposure of all surfaces. A sponge or cloth can achieve light scrubbing. In case of cups and utensils, special brushes have to be used for the scrubbing. Alternately, light scrubbing by blasting granules of sand or similar material is possible.

A thermal process similar to the mechanical process may be used in dishwashing with the exception of using an air current sweeping across the dishware to provide heating that can remove vapors and solidify food residues to a degree sufficient for removal through suction ducts. To increase heat conduction dishes may be assembled on trays. An alternative process may involve moving the dishes through a tunnel where heat is applied and vapors are removed. In most cases, air is used in tunnel drying and dishware can move through the dryer either parallel or countercurrent to airflow. Hot air nozzles may supply heat. Drying of the liquid film, grease or food residues occurs very rapidly. This process is useful for dishes sensitive to exposure to heat for any appreciable length of time.

U.S. Pat. No. 5,113,881 to Lin et al. describes an ultrasonic device for cleaning and disinfecting fruits and vegetables in a water-filled tank. U.S. Pat. No. 4,836,684 to Javorik, et al. describes an ultrasonic cleaning device that utilizes ultrasonic transducers and generators to clean items contained in a liquid bath in a tank above the transducer assembly. U.S. Pat. No. 4,461,651 to Hall describes a sonic cleaning device and method for removing accumulated particles using sonic energy vibrations. U.S. Pat. No. 4,367,098 to McCord describes a method that uses ultrasonic transducers and fluids of different densities. U.S. Pat. No. 4,193,818 to Young et al. describes a method and apparatus for ultrasonic cleaning in a sealed vessel capable of carrying out high-pressure sterilization. U.S. Pat. No. 4,834,124 to Honda discloses an ultrasonic cleaning device that is used to clean objects by a cleaning liquid using ultrasonic waves spouted from a spouting port without soaking the objects.

To reduce the volume of water and chemical detergents used in dishwashing and thus reduce the volume of gray water produced, there have been innovations in the ultrasonic cleaning of kitchenware and tableware items. For example, U.S. Pat. No. 5,218,980 to Evans describes an ultrasonic dishwashing system in which a controller rapidly varies the frequency of the ultrasonic signals and rapidly cycles the signals on and off. U.S. Pat. No. 3,854,998 to Jacobs discloses a fluid-powered ultrasonic washing, rinsing, and drying system for a dishwasher.

A partnership in the state of California formed between Southern California Edison and the California Division of Water Resources supported testing of a prototype ultrasonic dishwasher system manufactured by Ultrasonic Products, Inc., at the University of California at Santa Barbara. Ultrasonic dishwashers gently bombard grimy dish grease with sound waves. Instead of spraying, dishware is immersed in a tank of water and bombarded with high frequency sound waves that create tiny vapor bubbles to dislodge caked on grime, leading to a drop in hot water use by 25-50%.

Ultrasonic cleaning systems can save energy compared to traditional detergent-based dishwashers because they use lower water temperature and therefore use less energy. While ultrasonic cleaning reduces temperature and energy requirements, it still requires a cleaning solution and an appreciable amount of water in which dishware must be submerged for transfer of ultrasonic energy to cause the cavitation that effectively cleans soiled surfaces. Thus, there is a need for a dishwashing device that effectively removes food residue from dishware without the liquid transmission medium that ultrasonic cleaning requires. Another limitation on ultrasonic cleaning of dishware is that it generally requires the transducers to be near the soiled surface, which can limit the effective volume of cleaning Note also that cavitation and implosion in food residue film contaminates the cleaning medium, typically a combination of water and one or more cleaning solvents such as a surfactant or detergent. These food residues in solution or suspension must be collected, removed, and disposed.

Blasting and Dry Medium Cleaning

Abrasive blasting or sandblasting has long been a powerful cleaning technique, a process in which compressed air carrying abrasive particles rapidly strips away surfaces and thick coatings. Sandblasting removes rust from ferric metals and removes dirt from brick and other masonry. In more controlled applications, sandblasting cleans circuit boards and prepares surfaces to be painted. In combination with appropriate chemicals, abrasive blasting degreases components. Tuning of the power and precision of sandblasting is possible by varying air pressure, diameter of the nozzle, distance from the object, particle flow rate, and composition of the particles in terms of both size and material.

In traditional blasting based dishwasher machines, the blasting material must be recycled unless a huge amount of it is stored for extended operations. Reuse of silica-based blasting agents, such as sand or glass beads, is possible with separation and high temperature incineration of the media. Some of the medium will inevitably mix with food contaminants, but the medium, which is equivalent to sand, is environmentally safe and may be safely dump into seawater or a landfill without adverse effects. If the medium is plastic, a small amount of chemical cleaner or water cleans the plastic beads. Since the structure of the beads is unaffected by their use in cleaning, the beads are capable of being used multiple times with occasional refills to replace beads lost to structural failure, worn away by friction, and lost with disposal of food waste.

Using a non-disposable blasting medium to clean dishware requires a method of separating the blasting medium, which is capable of reuse, from food particles. The waste food particles and a small amount of the blasting medium may go into the trash, composted or other disposal techniques. Methods of separating food from blasting medium may include technologies such as gravity separation, inertia separation, centrifugal or cyclone separation, screen filtration, and incineration.

There have been previous attempts to recycle blasting media efficiently, which would be important in a dishwashing mechanism. U.S. Pat. No. 5,056,275 to Wada et al. describes a continuously operable hydraulic abrasive blasting apparatus including an abrasive storage tank, a recovery tank, and a hydraulic pressurized tank. One goal of this mechanism was to separate debris from an abrasive blasting medium so that the medium was capable of reuse. U.S. Pat. No. 4,382,352 to Nelson describes a blasting machine for cleaning surfaces, with a means to separate the blasting material from the debris and to clean and reuse the blasting material.

U.S. Pat. No. 4,804,488 to Alvemarker describes blasting bodies adapted for cleaning utensils in an admixture with dishwashing water, comprising about 60% by weight mineral filler selected from the group consisting of silicate, sulphate and carbonate, a plastic binder in the form of particles selected from the group consisting of polyamide and polyethylene, and at least 1% by weight chalk. The bodies in the medium, which are circular or polygonal in transverse cross section, each have a specific gravity of at least 2.0, a Moh hardness of at least 3.0, a mass of about 0.04 g, a length of about 3 mm, and a width of about 2.5 mm. The blasting bodies mix with dishwashing water and the mixture sprays against utensils from nozzles in a dishwasher to dislodge and remove residue. Upon completion of a cleaning cycle, the water typically passes through a sieve or strainer to separate the blasting bodies from the gray water. The bodies are collected for reuse. Alternately, the blasting bodies may settle in the machine as the dishwashing water is removed and are then reintroduced into the fresh dishwashing water. U.S. Pat. No. 5,735,730 to Jonemo at al. describes methods for separating granules from dishwater when the granules are heavier than the liquid, which would typically be water. U.S. Pat. No. 5,667,431 to Mortin describes an alternative dishwasher design employing washing liquid and blasting agents.

Issued patents describe certain wet blasting techniques in application to dishwashing such as U.S. Pat. No. 3,323,159 to Ummel et al., U.S. Pat. No. 3,272,650 to MacVittie, and U.S. Pat. No. 4,374,443 to Mosell. The blasting bodies used in dishwashing have the form of metal spheres, sand, crushed marble, or other heavy and hard blasting materials. Blasting bodies of such hardness, e.g. marble, are problematic in that they cause wear on washed utensils. On the other hand, blasting bodies may have the form of lightweight plastic pellets, which float in dishwashing water. Relatively hard plastic, such as polyoxymethylene, may be the plastic used to form such pellets.

In U.S. Pat. No. 4,959,930, Tsutsumi describes a washing machine liquid detergent applied to shots having relatively low hardness, which are then impinged against an object to be washed. Although the machine is very effective in cleaning very dirty dishware, the use of blasting detergent shots and heated water, excess water, detergent and energy use would be problematic in many situations.

To limit the volume of freshwater consumed and the contamination and volume of wastewater produced, U.S. Pat. No. 5,657,501 to Refai appears to disclose washing by the use of at least one polycarbonate contact body along with soiled items to improve efficiency of the cleaning process. U.S. Pat. No. 4,333,771 to Altenschopfer et al. describes a detergent composition with a mechanical cleaning effect for hard surfaces, particularly cooking and baking utensils, comprising a mixture of granular particles, the granular particles consisting substantially of a powdered to granulated component of conventional mechanical dishwashing agents capable of rapidly dissolving or finely dispersing in water, and a granulated component comprising finely divided, water insoluble inorganic compounds. However, neither of these processes eliminates wastewater or cleans efficiently without chemical detergents.

U.S. Pat. Nos. 6,609,960 and 6,280,301 to Rogmark describes a granule dishwasher with easily removable granule collectors and a method of use. Soiled articles are placed in the treatment chamber to be washed with a mixture consisting of liquid and granules that is sprayed at the articles under high pressure.

Many blasting techniques require a chemical element, such as surfactants, detergents, or solvents, to do the majority of the cleaning, assisted by blasting agents. In such techniques, blasting merely assists the chemicals by increasing the available surface area and providing access to the bases of thick residues by removing their upper layers. However, such techniques usually require water to remove both the detergent and the excess blasting media, requiring a freshwater supply and gray water disposal.

A cleaning process using hard or heavy dry-blasting media as disclosed in prior art causes wear on utensils. On the other hand, wet blasting media require significant amounts of water to achieve a cleaning effect with their softer media, which serves more as a catalyst to the detergent-based cleaning process than as a cleaning agent. Thus, there exists a need for an improved dry blasting dishwashing system that does not cause wear of dishware and would significantly reduce or eliminate water use.

Other Dishwashing Systems

To reduce detergent use in dishwashing loads, U.S. Pat. No. 6,680,287 to Wisniewski, et al. and U.S. Pat. No. 6,689,736 to Thomas et al. describe a dishwashing, cleaning water insoluble wipe comprising a substrate impregnated with a cleaning composition containing a cellulosic polymer.

Berryman (2004) at the University of Alberta, Canada described the development of a waterless dishwasher in response to growing concerns over both unsustainable water consumption and the problem of diminishing urban living space. Dirty dishes are placed on a retractable rubber conveyor. Upon activation, the conveyor automatically enters the cleaning unit. A blast of ultraviolet light first flash hardens food particles on a dish and kills bacteria. A sonic pulse is then applied that breaks down food particles and dislodges them from the dish. An electrostatic magnet then removes the vaporized particles before the dish exits the unit along the conveyor, spotless and bacteria-free. Besides saving much more space than a traditional dishwasher saves, cupboard space does not need to be cluttered with excess kitchenware since the instant cleaning action makes a build-up of dishes a thing of the past.

Douglas Nash, Ross Nicholls and Oystein Lie, students from the University of New South Wales in Australia, designed the Rockpool, a waterless dishwasher concept (Fitzgerald, 2005; Anon, 2004) that reduces strain on the environment and addresses consumers' concern for water use and the inconvenience of loading and unloading dishes in traditional dishwashers. Supercritical carbon dioxide is used in a closed-loop operation to clean the dishes. Under pressure, the carbon dioxide takes on special properties of a liquid and a gas so it dissolves grease and oil and it has no surface tension so it will cover everything, like a gas. The Rockpool is quiet since there are no moving parts. Supercritical carbon dioxide has been used in some industrial cleaning processes, but this is the first time it has been considered for a dishwasher. NASA is examining similar technology for cleaning processes on manned missions to Mars.

Generally, remote population pockets, campsites, nomadic or mobile communities, desert and arid regions suffering from lack of water, utility services and wastewater processing facilities have a great need for an energy-saving mobile dishwashing system for temporary or routine use that minimizes the amount of water consumed and requires no detergent. There is an even greater need aboard ships for a dishwashing system that is easy to operate and maintain, space-efficient, capable of cleaning dishware at the same rate as traditional dishwashing systems and compatible with the logistics of operation at sea, whether during times of peace or war.

Prior art references fail to disclose an environmentally friendly dishwashing system, requiring neither detergent nor water, that can operate continuously to clean and sanitize mass quantities of dishware without producing liquid, chemical, or secondary waste, and neither breaks nor abrades the surface of dishware being cleaned. Furthermore, none of the prior art describes a dry method of using fine natural sand or fine glass or plastic beads to clean kitchenware.

Thus, there is a yet unfulfilled need for a dishwashing system that produces minimal or no gray water or secondary waste streams, is user-friendly, is energy and cost efficient, has minimal life cycle cost, is acceptable by the user, removes grease and residual food particles, and leaves behind a minimum of post-cleaning spots and stains while keeping bacteria that may be on the dishware well below the permissible level.

SUMMARY

This disclosure provides an apparatus for washing dishware contaminated by food residue, including grease and water. The apparatus comprises a blasting medium storage system including a blasting medium. The apparatus further comprises a blasting medium transport system connected to the blasting medium storage system, the blasting medium transport system including a blasting medium delivery system. The apparatus further comprises an enclosure housing a carriage rack transport system, a portion of the blasting medium delivery system, and having a lower compartment. Blasting medium from the blasting medium storage system is moved from the blasting medium storage system by the action of the blasting medium transport system to the blasting medium delivery system located within the enclosure. The blasting medium delivery system directs blasting medium at a carriage rack supported by the carriage rack transport system. The used blasting medium and food residue falls into the lower compartment.

This disclosure also provides a dishwashing apparatus for washing dishware contaminated by food residue including grease and fatty acids. The apparatus comprises an air compressor, a feed valve connected to the air compressor by a first conduit, and a dividing manifold connected to the feed valve by a second conduit. The apparatus further comprises a first rail manifold connected to the dividing manifold by a third conduit, a second rail manifold connected to the dividing manifold by a fourth conduit, a first plurality of pressure heads connected to the first rail manifold, a first plurality of pressure nozzles, wherein every one of the first plurality of pressure heads has at least one pressure nozzle extending therefrom, a second plurality of pressure heads connected to the second rail manifold, and a second plurality of pressure nozzles, wherein every one of the second plurality of pressure heads has at least one pressure nozzle extending therefrom. The apparatus further comprises a blasting medium storage system. The blasting medium storage system includes a feed hopper and a fifth conduit connecting the feed hopper to the dividing manifold. The apparatus further comprises an enclosure, wherein the first rail manifold and the second rail manifold are positioned within the enclosure, a carriage rack transport system positioned in the enclosure, wherein the carriage rack transport system is configured to guide a carriage rack containing the dishware to a position longitudinally between the first plurality of pressure heads and the second plurality of pressure heads, and a return system located in a lower compartment of the enclosure, the return system including an angled portion. The components of the apparatus are connected in a manner that allows ease of assembly, disassembly and maintenance. Assemblage and communication between components of the apparatus provides as small footprint as possible for skid-mounting, vehicle-mounting and ease of transport from one location to the other. A blasting medium is transported through the fifth conduit to the feed valve by the action of compressed air from the air compressor flowing through first conduit and the feed valve. A combination of compressed air and blasting medium then flows through the second conduit, the dividing manifold, the third conduit, the first rail manifold to flow through the first plurality of pressure heads and then through the at least one pressure nozzle extending from every one of the pressure heads of the first plurality of pressure heads, and in parallel through the fourth conduit, the second rail manifold to flow through the second plurality of pressure heads and then through the at least one pressure nozzle extending from every one of the pressure heads of the second plurality of pressure heads. The combination of compressed air and blasting medium flows under pressure from the pressure nozzles to flow into the enclosure to impinge on the dishware in the carriage rack positioned in the carriage rack transport system. The action of the compressed air and blasting medium removes food debris from the surfaces of the dishware and the blasting medium and the food debris falls into the lower compartment to land on the angled portion.

This disclosure also provides a method of cleaning dishware without water or detergent. The method comprises placing the dirty dishware in an enclosure, forming a mixture of compressed air and a blasting medium in a blasting medium transport system, moving the mixture of compressed air and the blasting medium into the enclosure with the blasting medium transport system, directing the mixture of compressed air and the blasting at the dirty dishware to remove food residue using a blasting medium delivery system, and gathering the used blasting medium and the food residue for recycling or disposal in a blasting medium recovery system.

Advantages and features of the embodiments of this disclosure will become more apparent from the following detailed description of exemplary embodiments when viewed in conjunction with the accompanying drawings.

DETAILED DESCRIPTION

As will be seen, the present disclosure introduces improvements over existing dishwasher systems and practice since the primary washing is accomplished with dry blasting and does not require any water or detergent and does not produce any primary or secondary wastewater streams. A minimal amount of water may be used for the rinse cycle and for sterilization or sanitizing, which may be accomplished by steam or heated air.

Figure 1:
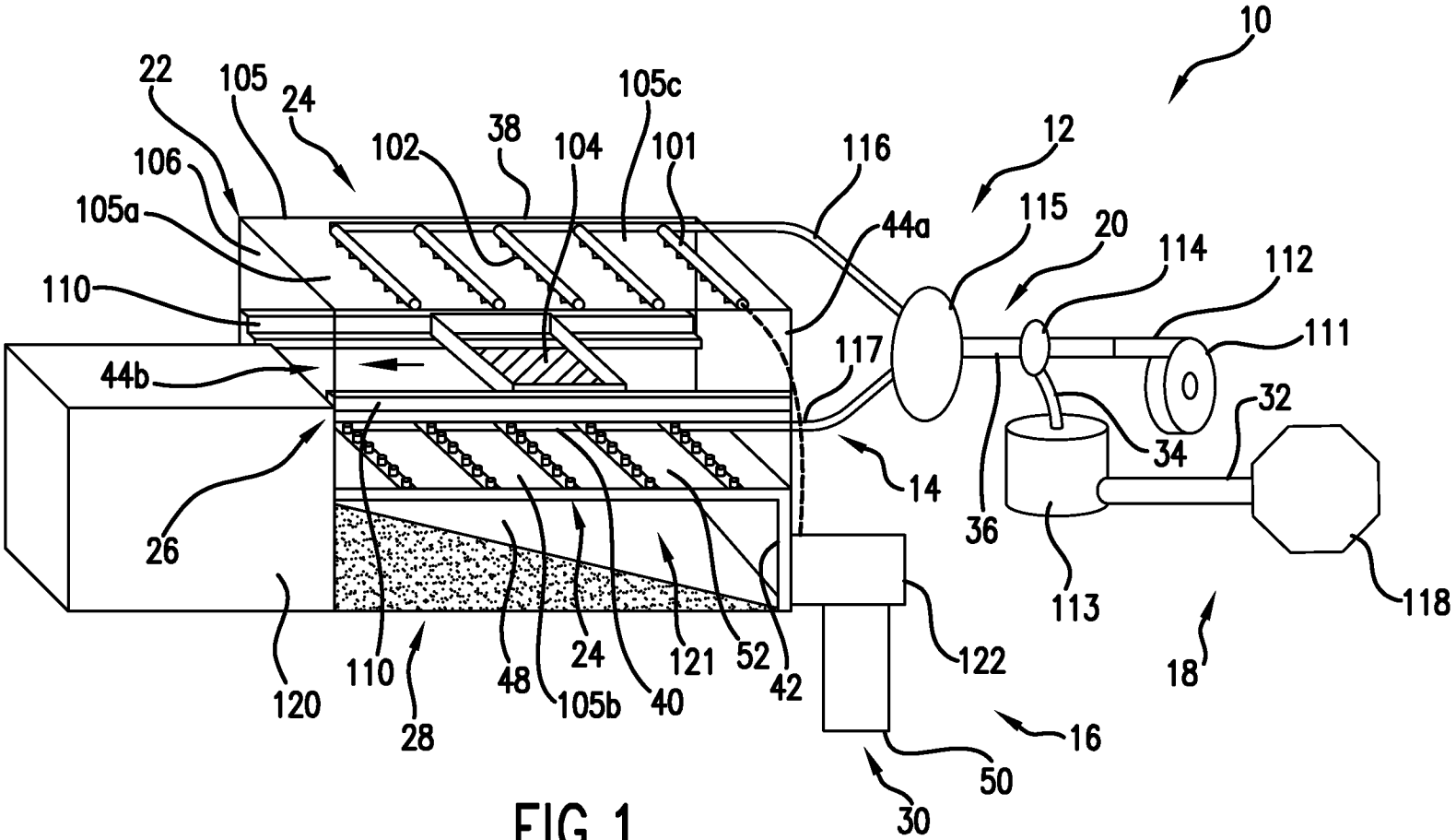
FIG. 1 is a stylized perspective view of a waterless dishwashing machine in accordance with a first exemplary embodiment of the present disclosure with some elements transparent to disclosure inner elements of the waterless dishwashing machine.
Figure 2:
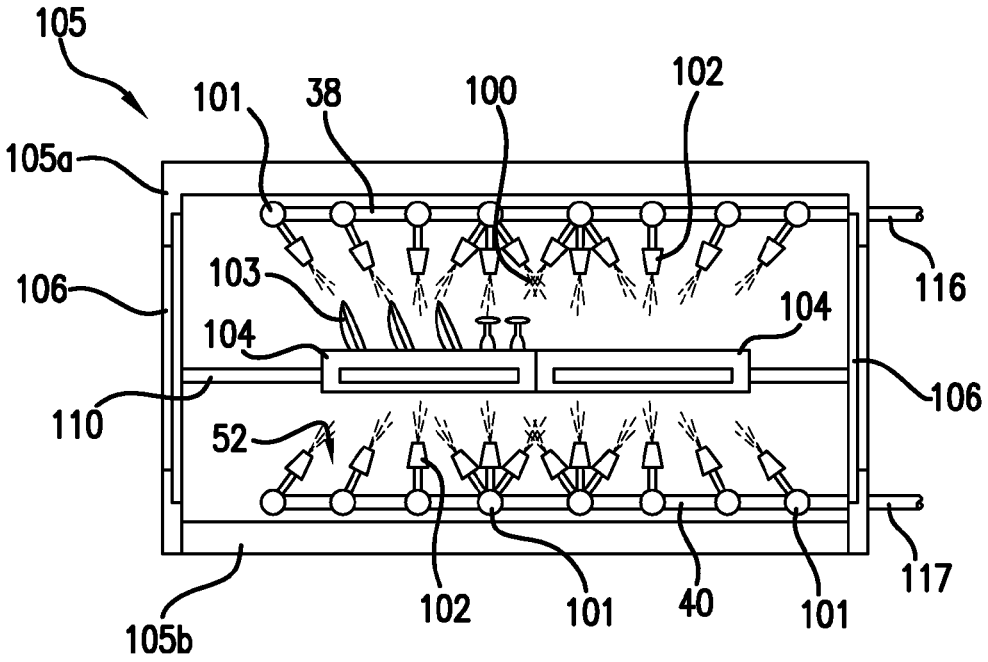
FIG. 2 is a side view of the waterless dishwasher system of FIG. 1 with a portion of an enclosure of the waterless dishwasher system removed to show the interior components of the enclosure.

Referring now to FIGS. 1 and 2, there is illustrated a dry blasting dishwasher system 10 of the present disclosure. Dishwasher system 10 includes a blasting medium delivery system 12, a dishwashing system 14, and a blasting medium recovery system 16.

Blasting medium delivery system 12 includes a blasting medium storage system 18 and a blasting medium transport system 20. Dishwasher system 14 includes an enclosure system 22, a blasting medium delivery system 24, and a rack transport system 26. Blasting medium recovery system 16 includes a return system 28 and a recovery storage system 30.

Blasting medium storage system 18 may further include a blasting medium replenishment hopper 118. A replenishment conduit 32 connects replenishment hopper 118 with a feed hopper 113. A feed conduit 34 connects feed hopper 113 to a feed valve 114, which is part of blasting medium transport system 20.

Blasting medium transport system 20 includes an air compressor 111, which connects to feed valve 114 by a compressor conduit 112. Feed valve 114 connects to a dividing manifold 115 by a feed valve conduit 36. A first manifold conduit 116 and a second manifold conduit 117 connect manifold 115 to a blasting medium delivery system 24. Blasting medium delivery system 24 includes first rail manifold 38, second rail manifold 40, a plurality of pressure heads 101, and a plurality of pressure nozzles 102. First manifold conduit 116 connects to first rail manifold 38. Second manifold conduit 117 connects to second rail 40. First rail manifold 38 and a second rail manifold 40 are located within dishwashing system 14. First rail manifold 38 and second rail manifold 40 supply and may connect directly or indirectly to a plurality of pressure heads 101. Each pressure head 101 includes one or more pressure nozzles 102 extending therefrom. Pressure nozzles 102 may be generally parallel to each other, or may be at varying angles to each other, as shown in FIG. 2.

Figure 3:
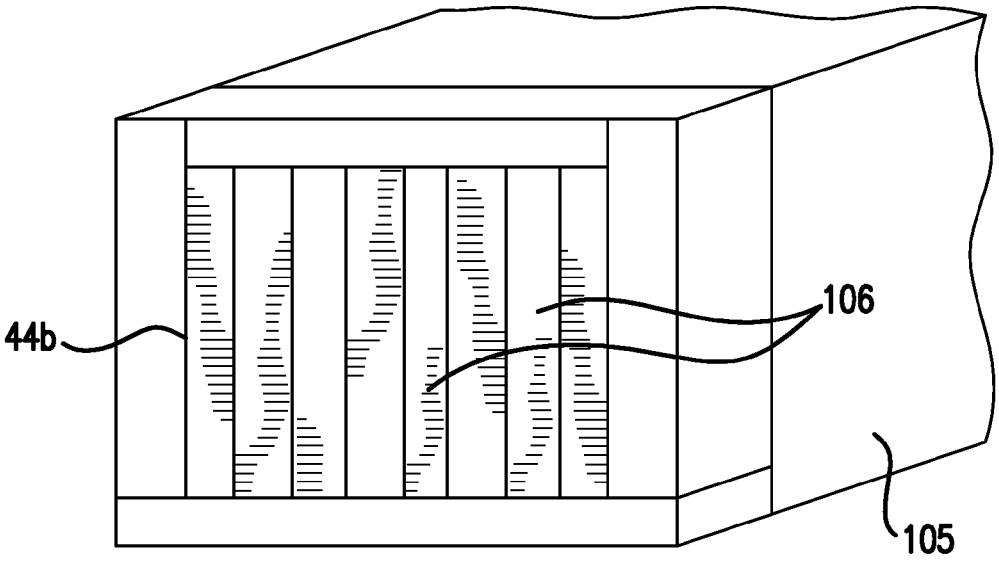
FIG. 3 is a perspective view of a first end of the waterless dishwasher system of FIG. 1.

Enclosure system 22 may include enclosure 105 that may have a stand 42 for support. Enclosure 105 may be formed of metal or a light transparent material to permit visual monitoring of the washing process to identify problems quickly. The light transparent material may be poly(methyl methacrylate), also called PMMA or acrylic glass. Enclosure 105 has seals to limit the escape of a blasting medium 100 from enclosure 105. As will be seen, each end of enclosure 105 has an opening 44 to permit access to the interior of enclosure 105. Opening 44*a* is at a first end of enclosure 105 and opening 44*b* is at a second end of enclosure 105. Opening 44*a* and opening 44*b* each have a covering, which may be in the form of flexible curtain barriers 106, shown in FIG. 3. Flexible curtain barriers 106 may be formed of a heavy rubber or a suitable flexible plastic.

Within enclosure 105 is a plurality of pressure heads 101 that are also a part of blasting medium delivery system 24. The position of pressure heads 101 may be at a top portion 105*a* or at a bottom portion 105*b* of enclosure 105. However, pressure heads 101 may be located in other places within enclosure 105. For example, pressure heads 101 may be located on a side portion 105C of enclosure 105. Pressure heads 101 may be in parallel rows, as shown in FIG. 1, but they may also be in non-parallel configurations.

Figure 4:
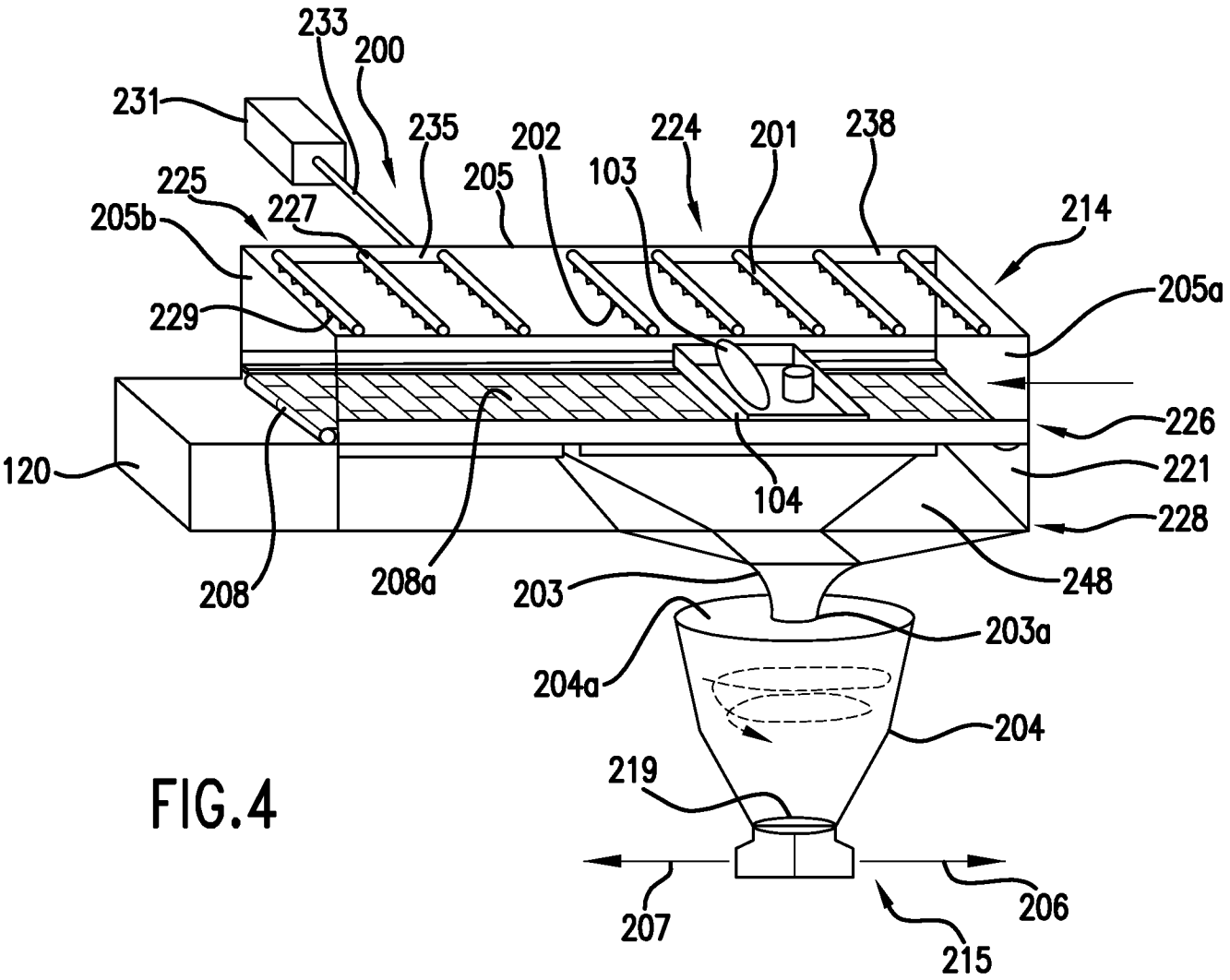
FIG. 4 is a perspective view of a waterless dishwasher system in accordance with a second exemplary embodiment of the present disclosure having an optional rinse and sanitizing stages and an optional collection separation stage.

Along a longitudinal direction of enclosure 105 is rack transport system 26. Rack transport system 26 may include a conveyor system, such as is shown in FIG. 4, or it may be a manual system, as is shown in FIG. 1. Rack transport system 26 may include a pair of guide rails 110. A carriage rack 104 contains features that slidingly mate carriage rail 104 with guide rails 110. Each carriage rack 104 contains features (not shown) for supporting dishware 103. As previously noted, dishware 103 may include an array of items used in a kitchen, for example, metal pots, pans, plastic, china or metallic plates, cups, glasses, bowls, metal silverware, utensils, flatware, trays, etc. Dishware 103 is in addition to the carriage rack 104 that holds the dishes and passes through the dishwasher. The material of carriage rack 104 may be plastic.

Located adjacent to dishwashing system 14 is blasting medium recovery system 16. Blasting medium recovery system 16 includes return system 28 located in a lower compartment 121, which may be a gravity system that guides a blasting medium 100 to recovery storage system 30. Return system 28 includes an angled slide or guide portion 48. Angled slide or guide portion 48 may be at an angle to cause gravity to move blasting medium 100 along with any food debris toward recovery storage system 30. Angled slide or guide portion 48 may be covered or coated with a friction resistant coating to enhance the movement of blasting medium 100 and food debris toward recovery storage system 30 further. Angled slide or guide portion 48 may also include a vibratory mechanism (not shown) to further encourage blasting medium 100 and food debris to move toward recovery storage system 30.

Recovery storage system 30 removably interfaces with lower compartment 121. The interface location is where angled slide or guide portion 48 positions used blasting medium 100 and food debris. Recovery storage system 30 includes an interface portion or spout 122 and a recovery reservoir 50.

This system works in the following manner. An operator or user inserts a carriage rack 104 loaded with one or more dishware 103 through opening 44*a* onto guide rails 110. The operator or user then manually pushes carriage rack 104 into enclosure 105. The operator or user may then load another carriage rack 104, which may be loaded with more dishware 103 or may be empty, through opening 44*a* onto guide rails 110 to advance the progress of the first carriage rack 104 containing the first load of dishware 103.

Now that a loaded carriage rack 104 is within enclosure 105, an operator or user turns on air compressor 111 in a first step. Compressed air flows from air compressor 111 to feed valve 114 by way of compressor conduit 112. Feed valve 114 has at least two operational positions. In one position, compressed air flows through feed valve conduit 36 to dividing manifold 115. In the other position, a combination of compressed air and blasting medium 100 flows through feed valve conduit 36 to dividing manifold 115. After an operator or user loads a carriage rack 104 with dishware 103 into enclosure 105, the operator sets feed valve 114 to supply compressed air only.

Compressed air flows into first manifold conduit 116 and second manifold conduit 117 by the action of dividing manifold 115. Note that dividing manifold 115 may include a heating element (not shown) to raise the temperature of the pressurized air, thereby increasing the pressure of the air further. From first manifold conduit 116, compressed air flows into first rail manifold 38. First rail manifold 38 divides the flow of compressed air into multiple paths, flowing into a first plurality of pressure heads 101. Once in the first plurality of pressure heads 101, the compressed air flows through a first plurality of pressure nozzles 102 and then into the interior of enclosure 105. From second manifold conduit 117, compressed air flows into second manifold rail 40. Second manifold rail 40 divides the flow of compressed air into multiple paths, flowing into a second plurality of pressure heads 101. Once in the second plurality of pressure heads 101, the compressed air flows through a second plurality of pressure nozzles 102 and then into the interior of enclosure 105. The operator leaves feed valve 114 in this position for a period to dry preexisting moisture and to harden any food particles or residue sticking to dishware 103 to facilitate removal by blasting medium 100.

After an operator or an optional sensor (not shown) determines air-drying is sufficient, the operator turns feed valve 114 to a second operational position for a second step. Associated with feed valve 114 is feed hopper 113. Feed hopper 113 holds blasting medium 100 until feed valve 114 connects feed hopper 113 to feed valve conduit 36 while air compressor 111 is operating. The action of airflow through feed valve 114 draws blasting medium 100 through feed conduit 34 into feed valve 114 when feed valve 114 is in the second operational position. Blasting medium 100 will mix with compressed air from air compressor 111 and the mixture will flow into feed valve conduit 36. Feed hopper 113 may be refilled manually at the end of one or more washing cycles or an optional blasting medium replenishment hopper 118 may automatically refill feed hopper 113 by way of replenishment conduit 32.

A mixture of compressed air and blasting medium 100 flows into first manifold conduit 116 and second manifold conduit 117 by the action of dividing manifold 115. Note that dividing manifold 115 may include a heating element (not shown) to raise the temperature of the pressurized air, thereby increasing the pressure of the air further. From first manifold conduit 116, compressed air and blasting medium 100 flow into first rail manifold 38. First rail manifold 38 divides the flow of compressed air and blasting medium 100 into multiple paths, flowing into a first plurality of pressure heads 101. Once in the first plurality of pressure heads 101, the flow of compressed air and blasting medium 100 flows through a first plurality of pressure nozzles 102 and then into the interior of enclosure 105. From second manifold conduit 117, compressed air and blasting medium 100 flow into second manifold rail 40. Second manifold rail 40 divides the flow of compressed air and blasting medium 100 into multiple paths, flowing into a second plurality of pressure heads 101. Once in the second plurality of pressure heads 101, the flow of compressed air and blasting medium 100 flows through a second plurality of pressure nozzles 102 and then into the interior of enclosure 105.

The orientation of the plurality of pressure heads 101 and the plurality of pressure nozzles 102 provide a distribution of blasting medium 100 to impinge on dishware 103. The impingement of blasting medium 100 on dishware 103 causes the removal of food debris, including grease and fatty acids. Enclosure 105, which includes flexible curtain barriers 106, keeps the combination of food debris and blasting medium 100 contained. The action of gravity causes food debris and blasting medium 100 to fall through gaps 52 between pressure heads 101 in lower portion 105*b* of enclosure 105. Once through gaps 52, food debris and blasting medium 100 falls into lower compartment 121 and then onto slide 48. Because slide 48 is set at an angle, food debris and blasting medium 100 slides toward spout 122 of recovery storage system 30. Once in spout 122, food debris and blasting medium 100 falls into recovery reservoir 50.

After sufficient time has passed to clean dishware 103, an operator or user moves feed valve 114 to the first operational position to permit compressed air only to flow into enclosure 105 in a third step. The flow of compressed air into enclosure 105 clears any residual blasting medium 100 and food debris from dishware 103. The flow of compressed air from compressor 111 also removes excess blasting medium 100 from compressor conduit 112, feed valve 114, feed valve conduit 36, dividing manifold 115, first manifold conduit 116, second manifold conduit 117, first rail manifold 38, second rail manifold 40, pressure heads 101, and pressure nozzles 102. The residual blasting medium 100 also falls through gaps 52 between pressure heads 101 in lower portion 105*b* of enclosure 105. Once through gaps 52, the residual blasting medium 100 falls into lower compartment 121, then onto slide 48 and then toward spout 122 of recovery storage system 30, as previously described. Once in spout 122, the residual blasting medium 100 falls into recovery reservoir 50.

In order to enhance movement of food debris and blasting medium 100 along slide 48, slide 48 may contain a shaker or vibrator (not shown). The action of such a shaker or vibrator would encourage food debris and blasting medium 100 to move downwardly along slide 48 toward spout 122 of recovery storage system 30. The vibrator may be electrical or may be mechanical.

The steps of this process may benefit by moving the air from compressor 111 through a heating element (not shown). The heated air may assist in sanitizing dishware 103. Yet another optional sanitizing configuration may use dry steam from a boiler, followed by pressurized hot air (not shown).

Following completion of the third step, the operator or user deactivates or de-energizes air compressor 111. A brief wait permits residual dust that may include food debris and blasting medium 100 to settle into lower compartment 121, limiting the amount of food debris and blasting medium 100 that escapes from enclosure 105. Additional carriage racks 104 pushed into a first end of enclosure 105 push a loaded carriage rack 104 toward a second end of enclosure 105. A loaded carriage rack 104 will eventually pass through opening 44*b* through *a* flexible curtain barrier 106 at the second end of enclosure 105 onto an unloading platform 120. Carriage rack 104 may be placed in a holding area so that dishware 103 may be used directly from carriage rack 104, or dishware 103 from carriage rack 104 may be moved to storage cabinets or containers (not shown). While not shown, dry blasting dishwasher system 10 may include a loading platform adjacent the first end of enclosure 105.

After completion of a cleaning cycle, an operator or user of dry blasting dishwasher system 10 may disconnect recovery storage system 30 from lower compartment 121. Blasting medium 100 may now be recycled. If a silica or mineral-based blasting medium is employed, the collected mixture of blasting medium 100 and dried food particles and residue may be burned in a furnace to incinerate the attached organic material. If a separation process is used to recycle blasting medium 100, food debris separated from used blasting medium 100 may be incinerated or placed in a trash or other disposal receptacle. Blasting medium 100 may be cleaned separately.

A second exemplary embodiment dry blasting dishwasher system 200 is shown in FIG. 4. Dishwasher system 200 implements elements of the dry blasting system described in the first exemplary embodiment in a large semi-automated dishwashing system. Dishwasher system 200 includes a dishwashing system 214, supplied by a blasting medium delivery system 224 and a sanitizing system 225. Included within an enclosure 205 of dishwashing system 214 is a rack transport system 226. Located below enclosure 205 is a blasting medium return system 228. Return system 228 feeds into a blasting medium reclamation system 215.

Many of the elements of this embodiment are similar to the first exemplary embodiment. Blasting medium delivery system 224, located closer to a first end of enclosure 205 than a second end, connects to a blasting medium transport system that may be similar to blasting medium transport system 20 that may further connect to a blasting medium storage system that may be similar to blasting medium storage system 18. Blasting medium delivery system 224 may include a first rail manifold 238. First rail manifold 238 may connect to a plurality of pressure heads 201. Each pressure head 201 may contain one ore more pressure nozzles 202.

Located adjacent to blasting medium delivery system 224 is sanitizing system 225, which may be located closer to a second end of enclosure 205 than a first end. Note that blasting medium delivery system 224 may also be described as being located upstream of sanitizing system 225 and by extension sanitizing system 225 is downstream from blasting medium delivery system 224. Sanitizing system 225 includes a steam or hot air generator 231, a steam or hot air conduit 233, a steam or hot air rail 235, and one or more hot air or steam pressure heads 227. Steam or hot air generator 231 connects to pressure heads 227 by way of steam or hot air conduit 233 and steam or hot air rail 235. At least one hot air or steam nozzle 229 extends from hot air or steam pressure heads 227.

Rack transport system 226 includes a conveyor mechanism 208.

Return system 228 includes a slide or guide portion 248 positioned below rack transport system 226 in an area below blasting medium delivery system 224. Slide or guide portion 248 is located in a lower compartment 221. Slide or guide portion 248 may have a vibratory mechanism (not shown) associated with it. Slide or guide portion 248 angles downwardly to mate with a funnel 203. Funnel 203 may be associated with a blasting medium recovery storage system, which is similar to recovery storage system 30 of the first exemplary embodiment, or end portion 203*a* of funnel 203 may be positioned within an opening 204*a* of a hydrocyclone or cyclone separator unit 204. Cyclone separator unit 204 contains a filtration system 219 near the output of the cyclone separator unit 204. Cyclone separator unit 204 contains at least two outlets. A first outlet 206 is connected to a blasting medium storage system similar to storage system 18 described in the first exemplary embodiment. A second outlet 207, which is for food residue and particles, connects to a collection system (not shown).

This system works as follows. An operator or user loads a carriage rack 104 through a first end 205*a* of enclosure 205 and places carriage rack 104 on conveyor 208. Conveyor 208 carries carriage rack 104 into enclosure 205. As carriage rack 104 passes a plurality of pressure heads 201, a blasting medium 100, forced into the interior of enclosure 205 by a plurality of pressure nozzles 202, impinges on carriage rack 104 and dishware 103 located within carriage rack 104. The force and configuration of blasting medium 100 removes food debris, including grease and fatty acids, from dishware 103. The speed of conveyor 208, which is adjustable, determines the amount of time dishware spends in the area of pressure heads 201. Conveyor 208 next moves carriage rack 104 into the area of hot air or steam pressure heads 227. As a first step, steam may briefly emit from steam pressure heads 227. The heat from this steam performs a sterilizing function for dishware 103. Next, hot air may emit from hot air or steam pressure heads 227 to provide a drying function and to assist in sterilizing dishware 103 further. The total amount of time for the dishwashing process, from loading of a carriage rack 104 at first end 205*a* of enclosure 205 to removal of carriage rack 104 at second end 205*b* of enclosure 205, is approximately five minutes, which is comparable to the total time for water-based dishwasher systems using a conveyor.

Automatic controls (not shown) may drive conveyor 208. The automatic controls must insure smooth movement of each carriage rack 104 and its load of dishware 103 from the loading station through different portions of dishwasher system 200 until reaching unloading platform 120. The automatic controls would include a motor start and stop, conveyor speed control, overload protection, emergency shutoff, and the ability of integrated sensors (e.g., magnetic, optical, etc., not shown) to detect the position of carriage rack 104 on conveyor 208. Using sensors to detect the presence and location of a carriage rack 104 on conveyor 208 enables blasting medium delivery system 224 and sanitizing system 225 to operate only when a rack 104 is present rather than continuously operating, thus conserving resources.

A combination of blasting medium 100 and food debris, including grease and fatty acids, passes through openings 208*a* in conveyor 208 and drops to slide or guide portion 248. Slide or guide portion 248 is at an angle that encourages gravity to move blasting medium 100 and food debris to slide toward funnel 203. Slide or guide portion 248 may include an electric or mechanical vibration mechanism (not shown) to enhance movement of food debris and blasting medium 100 toward funnel 203. Slide or guide portion 248 may also include a nonstick coating to minimize sticking of food debris and blasting medium 100 on the surface of slide or guide portion 248. Food debris and blasting medium 100 slides toward and enters funnel 203, falling through opening 203*a* of funnel 203 and entering opening 204*a* of cyclone separator 204. Cyclone separator 204 in combination with filtration system 219 separates blasting medium 100 from food debris. Blasting medium 100, which is generally clean at this point, flows through first outlet 206 and returns to a recovery storage system, which may be similar to recovery storage system 30. An additional apparatus may be placed between first outlet 206 and a recovery storage system to further clean and sterilize blasting medium 100. Food debris or residue exits reclamation system 215 from second outlet 207. This food debris or residue goes to a collection unit for disposal or incineration (not shown). To enhance the environmental friendliness of this configuration further, heat from incinerating the food debris, residue or waste may provide the energy used to create steam and hot air for sanitizing system 225.

Figure 5:
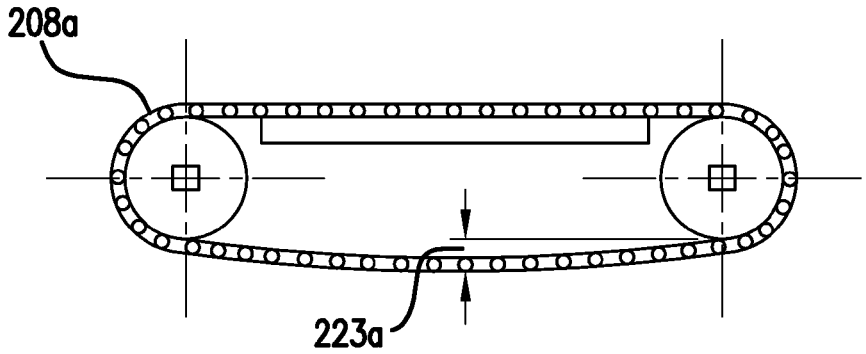
FIG. 5 is an elevation view of a first optional conveyor system in accordance with an exemplary embodiment of the present disclosure.
Figure 6:
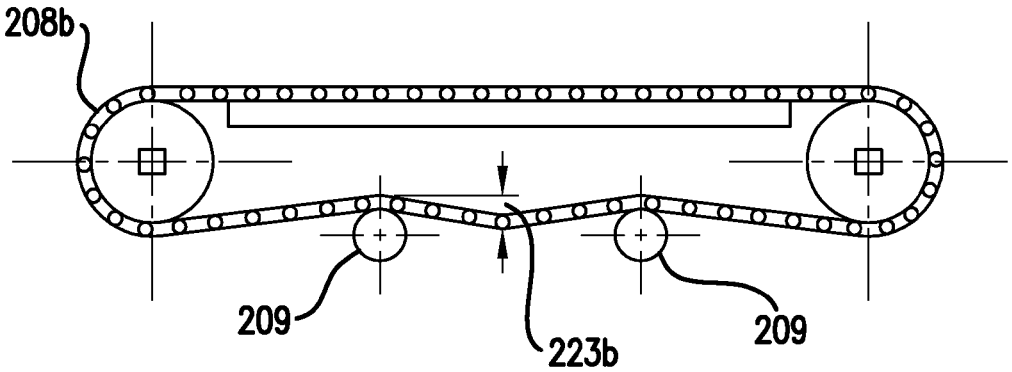
FIG. 6 is an elevation view of a second optional conveyor system in accordance with an exemplary embodiment of the present disclosure.

Conveyor 208 may be a straight-running conveyor belt system, as opposed to a side flexing conveyor system such as those manufactured by Intralox of Harahan, La. Several factors should be considered in choosing the appropriate material for the conveyor belt, which must be able to resist both heat and impact. Polypropylene, polyethylene, acetal, aluminum, stainless steel, carbon steel, and the like, as well as certain other plastics, are useable for a conveyor belt, but a preferred embodiment uses composite material(s) that resist heat and impact. Designing the conveyor also requires determining the best belt surface, link pitch, and drive method for the load of racks filled with kitchenware. The conveyor or belt must be of sufficient strength, taking into account the weight of dishware 103 and carriage racks 104, the length of the conveyor, elevation changes, desired operating speed, maximum operating temperature, and service duty (i.e., start and stops). Square shafts transmit torque without the need for troublesome keys and keyways found on round shafts, provided the shaft material is strong enough to bear the load safely. A direct drive is preferred over positive drive systems that use drive shafts and sprockets, thus eliminating wear problems associated with friction rollers. Depending on belt tension and length, roller supports 209, shown in FIG. 6, may be used to help tension the belt and control or reduce catenary sag 223*a*, shown in FIG. 5, to catenary sag 223*b* shown in FIG. 6. Other materials or configurations may be acceptable, but the aforementioned are considered desirable.

The drive motor for the conveyor (not shown) is selected based on a number of factors. The drive motor horsepower requirement is calculated as follows:

$$MotorHorsepower = \frac{BeltDrivePower}{100\% - \text{Total \% Losses}} \times 100$$

where the % Losses are the mechanical efficiency losses due to such factors as gear reduction, ball bearings, and roller chains; and the Belt Drive Power is the power needed to overcome the resistance of moving the belt and the product. The type of motor has to compensate for such factors as rapid starting of the conveyor system. Soft starting electric motors or fluid couplings can help reduce adverse effects of such loadings.

In the first exemplary embodiment waterless dishwashing system for cleaning dishware items described above, the blasting dishwashing machine for cleaning dishware items can be assembled anywhere and constructed from off-the-shelf components, including a commercial air compressor, portable sandblasting units (nozzles, hoppers, and feed systems), clear acrylic sheeting, aluminum angle braces, hoses, fittings and nozzles, and fasteners. The items needed for the construction and operation of the system include the following: an air compressor (5 HP, 230 Volts); four portable blasting units (including hoppers, nozzles, and feed hoses or conduits); a pressure regulator; a pressure gauge; aluminum angle 1×1×⅛"×8' (for guide rails); assorted fasteners; four acrylic sheets 24"×48" and 0.375" thick (for prototype enclosure); tubing, hoses, and connectors. This machine incorporates only four nozzles; three to direct the blasting agents at the dishware items with one nozzle to clear excess debris from the items. However, this system can include more nozzles since the construction is modular. As previously noted, enclosure 105 may be formed of poly(methyl methacrylate), also called PMMA or acrylic glass. The various conduits described may be in the form of tubing. Mounted to enclosure 105 are two rails 110 that support and guide carriage racks 104 which holds dishware 103. A carriage rack 103 that holds dishware 103 passes through a blasting field similar those in current water jet systems. Because of the simplicity of this structure, this arrangement is suitable for temporary installation at a camp and suitable for mobility.

Several types of blasting media are appropriate for cleaning effectiveness, abrasiveness, and recyclability and may be used as blasting medium 100. These include glass beads, including silicon or sand, and plastic beads of various sizes and hardness; e.g. plastic blasting media (20-40 U.S. Sieve); fine glass beads blasting media (100-170 U.S. Sieve); and coarse glass beads blasting media (50-70 U.S. Sieve).

Small plastic beads are safe in blasting delicate dishware without causing excessive wear, scratches on the surface of the dishware or causing nicks or chips at the edges. The blasting beads can also be recycled by cleaning them and re-introducing them into the blasting stream. However, chemicals are needed to clean the plastic beads. Glass beads offer exceptional cleaning capabilities and can be recovered and recycled to reduce the volume of secondary waste streams. The waste stream would consist of food particles and some blasting agent. However, both are environmentally safe, as the food is biodegradable and the glass/sand is environmentally neutral. Generally, silica-based material such as glass or other types of sand-based beads; e.g. clean natural fine sand, can be recycled without the aid of solvents or other chemicals. Since this material has a high melting point, it can be heated to incinerate and remove any contaminants as well as sterilize the medium, making it ready for reuse in blasting.

The contaminants that could be cleaned from dishware items and utensils include large food deposits, smaller food deposits, grease and films, stains, ketchup, mustard (fresh), mustard (dried), cottonseed oil, jelly, peanut butter, lipstick, and rice (soggy). Bacteria and microorganisms can be totally eliminated during sanitization by hot air or steam mist.

Dishware 103 may include plastic plates, bowls, trays, cups, and glasses; metal silverware; metal pots, pans, and utensils. Carriage racks 104 that hold the dishes and pass through the dishwasher are typical of large systems include marine ship dishwashers.

Blasting of dishware items is an effective cleaning method that virtually eliminates the gray water produced by the cleaning process. Glass beads, or silicon or sand, offer exceptional cleaning capabilities and can be recovered and recycled to reduce the volume of secondary waste streams. The waste stream consists of food particles and some blasting agent. However, both are environmentally safe, as the food is biodegradable and the glass or sand is environmentally neutral. This silicon (glass) blasting media may cause surface wear at high pressures, for example at 690.5 kPa (100 psi) and above. However, dishware would be cleaned without damage if the blasting system were operated at lower pressures. The process time increases for lower pressures, but remains within acceptable limits as compared to current dishwashing systems. Proper selection of fine sand particles/silica and adjustment of blasting pressure alleviates any concern about wear due to the hardness of the blasting agent.

Table I provides a rough comparison between operating parameters for a blasting dishwasher prototype and a typical water dishwasher system on board marine ships (such as the system manufactured by Insinger Machine Company). This water jet dishwasher system operates at 440 volts, 30 kW and 44.6 amperes and can clean a rack of dishes in approximately 5 minutes.

TABLE 1

| Comparison | | |
|---|---|---|
| | Water Jet | Blasting (prototype) |
| Voltage (volts) | 440 | 230 |
| Current (amperes) | 44.6 | 35 |
| Power (kW) | 30 | 8 |
| Cleaning Time/Rack (minutes) | 5 | 3-5 |
| Water Volume (liters) | 189 | 0 |

Dry blasting dishwasher system 10 requires most of its power for the air compressor. The system runs at 230 volts, 35 amperes, and 8 kW. The time required to clean dishes is approximately 3 minutes. A complete cleaning cycle takes place in under 5 minutes, including removal of bulk food, blast cleaning, rinse and sterilization. The cycle times for current dishwashing systems range from 3 to 5 minutes to clean and sterilize a rack of dishes. Cleaning times of 2 to 3 minutes are achievable using the blasting method without excess abrasion. Thus, the cleaning time required for blasting is comparable to current systems.

In blasting dishwasher machines, the blasting material is recycled. Otherwise, a huge amount of material must be stored for extended operations. By using silica based blasting agents, such as sand or glass beads, the blasting medium can recycle through separation and high temperature incineration of the media. Recycling of the silica beads ensures that the system does not require large tanks for media storage. Any medium discarded along with removed food contaminants is environmentally safe, since it is the equivalent of sand, and can be safely dumped into seawater or used as a landfill with no adverse effects.

Recycling is rather important when the dishwasher is in the scullery of navy ships or on marine vessels to minimize the amount of blasting material needed for extended periods, since the storage of blasting material requires valuable onboard space. Recycling of used blasting material, either during or between actual cleaning cycles, is necessary to reduce the storage volume and decrease the secondary waste streams resulting from the cleaning process. Since the removal of food residuals from dirty dishware items does not alter the makeup or structure of the blasting agents, whether plastic or silica based, the blasting media can be reused without limitation. The amount of blasting media needed for the dishwasher will remain practically constant except from minor losses, which need to be replenished occasionally. The recycling process regenerates or refreshes the blasting agent supply by separation of food residue, particles, or contaminants that may stick to the beads. In the case of silica-based beads, high heat may be employed with the recycling process to ready the material for further use. For plastic-based media, a small amount of chemical cleaner or water may clean the plastic beads.

Recycling of medium 100 generally falls into two categories: 1) in-process recycling, or 2) external recycling.

For in process recycling of medium 100, the recycling system receives used blasting medium 100 in addition to food residue from the cleaning process as the unit is cleaning dishware. The blasting agent is then treated and returned to the primary feed system for subsequent use. Benefits of this system include reduced material need and low operator intervention and hence it is usually the most desirable process. For external recycling, used blasting medium 100 is collected and recycled separately while the cleaning system is operating. This system reduces the complexity of the cleaning system itself, but requires larger quantities of blasting medium 100 since blasting medium 100 might not be recycled until a meal is finished. Waiting until a meal is complete may be acceptable since current cleaning systems are drained and cleaned between meals.

Separation options include technologies such as gravity separation, inertia separation, centrifugal or cyclone separation, screen filtration, and incineration.

Gravity separation is one of the simplest forms of separation, although it is somewhat inefficient because only materials with large differences in particle size and mass are separable. To be effective, the cross sectional area of the flow passageways must be large enough to provide sufficiently low velocities and the length must be great enough along to allow separation of the particles without the particles being carried by inertial forces. This separation technique may be a preliminary separator to capture the blasting beads and larger particles before further filtration or separation, assuming that the space requirements are not prohibitive.

Inertial separation typically employs baffles that deflect and redirect material based on mass and density of the particles. The baffle type of inertial separators can be designed to occupy less space than typical gravity separation systems, but care must be taken to ensure that the turbulence fields created by the baffles do not interfere with the separation process.

Screen separation and filtration is another means to separate various materials based on particle sizes. This technique could be used in conjunction with other methods to recycle the blast material. It is important to consider the maintenance and cleaning requirements for filtration, since contamination can rapidly foul the filter, rendering it useless.

One of the most promising technologies that can be used to separate the output stream is centrifugal or cyclone separation, wherein radial acceleration or centrifugal forces separate various materials. The centrifugal settling velocity, which is the outward or radial velocity of a particle in the separator, can be expressed by the following equation for particles within the Stokes' law range:

$$V_c = \frac{\alpha_v}{K} d^2 \left(\frac{\rho - \rho_0}{\mu}\right) \frac{V_t^2}{R}$$

Where $V_c$=centrifugal settling velocity, $V_t$=tangential velocity of the particle, and R=radius of the circular path of the particle. Types of centrifugal separators include high velocity cyclones, low velocity cyclones, and dynamic fan collectors.

Employing inertial separation means, such as cyclonic separation to remove the beads from contaminants, the beads separate from the bulk of the food debris. The beads are then subjected to high temperature heating elements for cleaning. If blasting medium 100 is a silica-blasting medium or other, similar type of blasting beads, the used medium can be heated to a temperature high enough to incinerate food particles. Off-the-shelf components or subsystems can be used to construct a separation and recycling unit. For example, abrasive separators used in the blasting field could be acquired and modified to work with the dishwashing system. Modifications or custom designs may be needed for integration with the other dishwashing components, taking into account the available space. These separators are typically based on a cyclonic design, such as the Cadillac brand abrasive separator available from Grainger industrial equipment supplies. The separator incorporates air volume control, variable negative pressures, and built-in filtration and collection in a durable polyethylene body.

In one embodiment of the present disclosure, steam jets are used as a final rinse cycle. The water required by the steam jets would be considerably less than for current water jet systems. In order to sterilize the dishes properly and to ensure that there is no residual blasting agent, a final stage employing heated air or steam jets or both in the cleaning cycle is added. The steam jets, directed at the dishware, remove any residual blasting agent from dishware surfaces. The combination of steam jets and heated air not only ensure thorough cleaning, but also serve to sterilize the dishware. Current dishwashing systems use two cycles, one cycle uses heated water and detergent and one cycle uses hotter rinse water to remove detergent and to sterilize the dishware. The goals of these two cycles are accomplished by dry blasting dishwasher system 10 with considerably lower water usage, since the only water used is by the steam jets, which is a considerably lower volume than used by water jets.

While various embodiments of the disclosure have been shown and described, it is understood that these embodiments are not limited thereto. The embodiments may be changed, modified and further applied by those skilled in the art. Therefore, these embodiments are not limited to the detail shown and described previously, but also include all such changes and modifications.

We claim:

1. A dishwashing apparatus for washing dishware contaminated by food residue including grease and water, the apparatus comprising:

a blasting medium storage system including a dry blasting medium;

a blasting medium transport system connected to the blasting medium storage system, the blasting medium transport system including a blasting medium delivery system, the blasting medium transport system including a valve, the valve being connected to a source of compressed air and to the blasting medium storage system, the valve being adjustable such that only compressed air flows through the valve from the blasting medium transport system to the blasting medium delivery system and alternatively a combination of compressed air and the dry blasting medium flows through the valve from the blasting medium transport system to the blasting medium delivery system; and an enclosure housing a carriage rack transport system, housing at least a portion of the blasting medium delivery system, and having a lower compartment;

wherein the dry blasting medium from the blasting medium storage system is moved from the blasting medium storage system by action of the blasting medium transport system to the blasting medium delivery system located within the enclosure;

wherein the blasting medium delivery system directs only compressed air to provide a waterless rinse, or, alternatively, directs the combination of compressed air and the dry blasting medium at a carriage rack supported by the carriage rack transport system to provide waterless cleaning; and wherein used blasting medium and food residue falls into the lower compartment.

2. The dishwashing apparatus of claim 1, further including a recovery storage system, the recovery storage system including a spout portion interfacing the recovery storage system with the lower compartment and a recovery reservoir connected to the spout portion, wherein the used blasting medium and the food residue that lands in the lower compartment slides into the spout portion and then into the recovery reservoir.

3. The dishwashing apparatus of claim 1, wherein the food residue includes large food deposits, small food deposits, grease, oil film, stains, ketchup, fresh mustard, dried mustard, cottonseed oil, jelly, peanut butter, lipstick, and wet rice.

4. The dishwashing apparatus of claim 1, wherein the blasting medium transport system further includes an air compressor for providing a source of compressed air.

5. The dishwashing apparatus of claim 1, wherein the blasting medium delivery system is adjustable to provide different blasting pressures suitable for different particles so as to alleviate wear due to the hardness of a particular blasting particle.

6. The dishwashing apparatus of claim 1, wherein the blasting medium transport system is adjusted to provide, in sequence, only compressed air, followed by the combination of compressed air and the dry blasting medium, followed by only compressed air to remove the used blasting medium and food residue dust from the dishware.

7. The dishwashing apparatus of claim 1, further comprising a sanitizing system, wherein the sanitizing system is connected to a source of steam or hot air under pressure and the sanitizing system directs pressurized steam or hot air into the enclosure.

8. The dishwashing apparatus of claim 1, wherein the carriage rack transport system further includes a conveyor system.

9. The dishwashing apparatus of claim 1, further including a hydroclone separator positioned below an angled surface, wherein the used blasting medium and the food residue that land on the angled surface slides into the hydroclone.

10. The dishwashing apparatus of claim 1, wherein the dry blasting medium is selected from a group consisting of 20-40 U.S. Sieve plastic blasting media, 100-170 U.S. Sieve glass blasting media, 50-70 U.S. Sieve glass blasting media.

11. The dishwashing apparatus of claim 1, wherein the blasting medium delivery system includes a plurality of pressure nozzles, the plurality of pressure nozzles is directed toward the carriage rack transport system at a plurality of angles with respect to each other.

12. A dishwashing apparatus for washing dishware contaminated by food residue including grease and water, the apparatus comprising:

a blasting medium transport system, including:

an air compressor;

a feed valve connected to the air compressor by a first conduit, wherein the feed valve is adjustable to provide compressed air only and alternatively a combination of compressed air and a dry blasting medium;

a dividing manifold connected to the feed valve by a second conduit;

a first rail manifold connected to the dividing manifold by a third conduit;

a second rail manifold connected to the dividing manifold by a fourth conduit;

a first plurality of pressure heads connected to the first rail manifold;

a first plurality of pressure nozzles, wherein every one of the first plurality of pressure heads has at least one pressure nozzle extending therefrom;

a second plurality of pressure heads connected to the second rail manifold; and a second plurality of pressure nozzles, wherein every one of the second plurality of pressure heads has at least one pressure nozzle extending therefrom;

a blasting medium storage system, including:

a feed hopper; and a fifth conduit connecting the feed hopper to the feed valve;

an enclosure, wherein the first rail manifold and the second rail manifold are positioned within the enclosure;

a carriage rack transport system positioned in the enclosure, wherein the carriage rack transport system is configured to guide a carriage rack containing the dishware to a position longitudinally between the first plurality of pressure heads and the second plurality of pressure heads; and a return system located in a lower compartment of the enclosure, the return system including an angled portion;

wherein the feed valve of the blasting medium transport system is configured to provide only compressed air during a waterless rinse or, alternatively, a combination of compressed air and the dry blasting medium during a waterless wash, wherein the dry blasting medium is transported through the fifth conduit to the feed valve by action of compressed air from the air compressor flowing through the first conduit and the feed valve;

wherein the combination of compressed air and the dry blasting medium flows through the second conduit, the dividing manifold, the third conduit, the first rail manifold to flow through the first plurality of pressure heads, and then through the at least one pressure nozzle extending from every one of the pressure heads of the first plurality of pressure heads, and in parallel through the fourth conduit, the second rail manifold to flow through the second plurality of pressure heads, and then through the at least one pressure nozzle extending from every one of the pressure heads of the second plurality of pressure heads;

wherein the combination of compressed air and the dry blasting medium flows under pressure from the pressure nozzles to flow into the enclosure to impinge on the dishware in the carriage rack positioned in the carriage rack transport system;

wherein action of the compressed air and the dry blasting medium removes food debris from the surfaces of the dishware; and wherein used blasting medium and the food debris falls into the lower compartment to land on the angled portion.

13. The dishwashing apparatus of claim 12, wherein food debris includes large food deposits, small food deposits, grease, oil film, stains, ketchup, fresh mustard, dried mustard, cottonseed oil, jelly, peanut butter, lipstick, and wet rice.

14. The dishwashing apparatus of claim 12, wherein the blasting medium transport system is adjustable to provide different blasting pressures suitable for different particles so as to alleviate wear due to the hardness of a particular blasting particle.

15. The dishwashing apparatus of claim 12, wherein the feed valve is adjusted to provide, in sequence, only compressed air, followed by the combination of compressed air and the dry blasting medium, followed by only compressed air to remove the used blasting medium and food debris dust from the dishware.

16. The dishwashing apparatus of claim 12, further comprising at least one additional pressure head, the at least one additional pressure head having at least one additional pressure nozzle, and wherein the at least one additional pressure head is connected to a source of steam or hot air under pressure and the at least one additional pressure nozzle directs pressurized steam or hot air into the enclosure.

17. The dishwashing apparatus of claim 12, further including a recovery storage system, the recovery storage system including a spout portion interfacing the recovery storage system with the angled portion and a recovery reservoir connected to the spout portion, wherein the used blasting medium and the food debris that land on the angled portion slide into the spout portion and then into the recovery reservoir.

18. The dishwashing apparatus of claim 12, further including a hydroclone separator positioned below the angled portion, wherein the used blasting medium and the food debris that lands on the angled portion slide into the hydroclone.

19. The dishwashing apparatus of claim 12, wherein the plurality of pressure nozzles is directed toward the carriage rack transport system at a plurality of angles with respect to each other.

* * * * *